US009947290B2

(12) United States Patent
Kang et al.

(10) Patent No.: US 9,947,290 B2
(45) Date of Patent: Apr. 17, 2018

(54) MULTI EMBEDDED TIMING CONTROLLER, DISPLAY PANEL, AND COMPUTER SYSTEM HAVING THE SAME

(71) Applicant: SAMSUNG ELECTRONICS CO., LTD., Suwon-si (KR)

(72) Inventors: Sungho Kang, Daegu (KR); Kyeonghwan Kwon, Seoul (KR); Choong-Bin Kim, Seoul (KR); Yeonsook Park, Seoul (KR); Hyejin Jung, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 184 days.

(21) Appl. No.: 14/976,310

(22) Filed: Dec. 21, 2015

(65) Prior Publication Data

US 2016/0189668 A1 Jun. 30, 2016

(30) Foreign Application Priority Data

Dec. 29, 2014 (KR) ..... 10-2014-0192300

(51) Int. Cl.
*G09G 5/00* (2006.01)
*G09G 3/20* (2006.01)

(52) U.S. Cl.
CPC ..... *G09G 5/006* (2013.01); *G09G 3/20* (2013.01); *G09G 2310/0218* (2013.01); *G09G 2310/08* (2013.01); *G09G 2320/103* (2013.01); *G09G 2330/021* (2013.01); *G09G 2330/026* (2013.01); *G09G 2330/12* (2013.01); *G09G 2352/00* (2013.01); *G09G 2360/18* (2013.01); *G09G 2370/04* (2013.01); *G09G 2370/10* (2013.01); *G09G 2370/14* (2013.01)

(58) Field of Classification Search
CPC ..... G09G 3/3696; G09G 5/18; G09G 3/3666; G05B 19/0423; G05B 19/4185; H04N 13/0497
See application file for complete search history.

(56) References Cited

U.S. PATENT DOCUMENTS

2006/0245515 A1 11/2006 Tachi
2010/0302214 A1* 12/2010 Kim ..... G09G 3/20 345/204
2012/0327047 A1 12/2012 Jin et al.
2013/0044553 A1 2/2013 Kwean
2013/0278591 A1 10/2013 Moon et al.

* cited by examiner

*Primary Examiner* — Sepehr Azari
(74) *Attorney, Agent, or Firm* — Sughrue Mion, PLLC

(57) ABSTRACT

A timing controller, a multi embedded timing controller (TED), and a display panel including a multi TED are provided. The timing controller includes: a first interface configured to receive data from a host device; and a second interface configured to communicate with another timing controller for driving the display panel, wherein the second interface is configured to communicate full link training information with the other timing controller.

17 Claims, 14 Drawing Sheets

FIG. 6

<table>
<tr><td></td><td>System Booting</td><td colspan="2">Normal Display</td></tr>
<tr><td>Interval</td><td>Idle Interval</td><td>Vertical Blank Interval</td><td>Active Video Data Interval</td></tr>
<tr><td>Bus Usage</td><td>Full Link Training</td><td>PSR/PSR2</td><td>2-Chip Sync./PSR2</td></tr>
<tr><td>Sync Bus[0]</td><td>HPD Indication</td><td>HPD Indication</td><td>HPD Indication</td></tr>
<tr><td>Sync Bus[1]</td><td>Lock</td><td>PSR States (PSR Entry/ Update/EXit/Abort)</td><td rowspan="4">SPI Bus</td></tr>
<tr><td>Sync Bus[2]</td><td>Training Period</td><td rowspan="3">Slave PSR Status</td></tr>
<tr><td>Sync Bus[3]</td><td>AUX Indication(Toggle)</td></tr>
<tr><td>Sync Bus[4]</td><td rowspan="2">Slave Training Results</td></tr>
<tr><td>Sync Bus[5]</td><td>PSR2 Identifier</td><td>PSR2 Identifier</td></tr>
</table>

FIG. 12

| | 7 | 6 | 5 | 4 | 3 | 2 | 1 | 0 |
|---|---|---|---|---|---|---|---|---|
| HB0 | Secondary Data Packet ID | | | | | | | |
| HB1 | Secondary Data Packet Type | | | | | | | |
| HB2 | Reserved=0 | | | Revision | | | | |
| HB3 | Reserved=0 | | | Number of Valid Payload Bytes | | | | |

| | | |
|---|---|---|
| DB0 | Stereo Interface Method Specific Parameter | Stereo Interface Method Code |
| DB1 | PSR | |
| DB3-DB2 | CRT Value R or Cr component | |
| DB5-DB4 | CRT Value G or Y component | |
| DB7-DB6 | CRT Value B or Cb component | |
| DB31-DB8 | Reserved=0 | |

FIG. 13

| ML0 | ML1 | ML2 | ML3 |
|---|---|---|---|
| SS | SS | SS | SS |
| HB0 | HB1 | HB2 | HB3 |
| PB0 | PB1 | PB2 | PB3 |
| DB0 | DB4 | DB8 | DB12 |
| DB1 | DB5 | DB9 | DB13 |
| DB2 | DB6 | DB10 | DB14 |
| DB3 | DB7 | DB11 | DB15 |
| PB4 | PB5 | PB6 | PB7 |
| DB16 | DB20 | DB24 | All 0'S |
| DB17 | DB21 | DB25 | All 0'S |
| DB18 | DB22 | DB26 | All 0'S |
| DB19 | DB23 | DB27 | All 0'S |
| PB8 | PB9 | PB10 | PB11 |
| SE | SE | SE | SE |

MULTI EMBEDDED TIMING CONTROLLER, DISPLAY PANEL, AND COMPUTER SYSTEM HAVING THE SAME

CROSS-REFERENCE TO RELATED APPLICATION

This application claims priority from Korean Patent Application No. 10-2014-0192300, filed on Dec. 29, 2014 in the Korean Intellectual Property Office, the entire contents of which are incorporated herein by reference in their entirety.

BACKGROUND

Field

Apparatuses and methods consistent with exemplary embodiments relate to a multi embedded timing controller (TED), and more particularly, to a multi TED that includes a master TED and at least one slave TED connected thereto through a sync bus and that differently uses the sync bus according to an operation state, a display panel having the same, and a computer system having the display panel.

Description of Related Art

As display devices have become larger in size and higher in resolution, demand has risen for a high-performance interface that transmits signals between a video source and a display device. To cope with this demand, Vx1 is becoming a substitute for a television (TV), and a DisplayPort (DP) is becoming a substitute for a laptop in the case of information technology (IT) products.

A DP interface is an interface regulated by Video Electronics Standards Association (VESA) and is an interface scheme that integrates low voltage differential signaling (LVDS), a related art internal interface standard, with DVI (Digital Visual Interface), an external connection standard. The DP interface can provide a digital internal connection between chips, as well as a digital external connection between products. As the two divided interfaces are integrated, higher color depth and resolution can be supported by widening data bandwidth. The DP interface has a bandwidth up to 10.8 Gbps, which is more than twice that of the existing DVI (maximum 4.95 Gbps). Additionally, the DP interface can simultaneously transmit up to six streams of 1080i (three streams of 1080p) through one connector connection by supporting multi-streams using a micro-packet architecture.

Recently, VESA announced a new version of the embedded DisplayPort (eDP) standard. The eDP standard is an interface standard corresponding to the DP interface designed for embedded display applications, including notebook personal computers (PCs), tablet PCs, netbooks, and all-in one desktop PCs. In particular, the eDP v1.3 includes a new panel self-refresh (PSR) technique that was developed to save system power and further extend battery lifetime in portable PC systems. The PSR technique uses a memory mounted in a display to display an original image as it is while minimizing power consumption, thereby increasing battery usage time in portable PC systems.

Meanwhile, as a screen of a portable terminal becomes larger, the number of channels sharply increases, and higher resolution display devices are used, it is difficult for one embedded timing controller (TED) to drive a display panel. Accordingly, the display panel may be driven using a multi embedded timing controller (multi TED).

Nowadays, set makers in a notebook or a tablet PC market still use an eDP solution because of an electro-magnetic interference (EMI) issue. However, when the multi TED is used, hardware and software with respect to the mobile device should be revised.

SUMMARY

Aspects of one or more exemplary embodiments provide a multi TED capable of transmitting and receiving data without change of hardware or software of the host.

Aspects of one or more other exemplary embodiments provide a display panel including the multi TED.

Aspects of one or more other exemplary embodiments provide a computer system including the display panel.

The technical objectives of the inventive concept are not limited to the above disclosure; other objectives may become apparent to those of ordinary skill in the art based on the following descriptions.

According to an aspect of an exemplary embodiment, there is provided a timing controller for driving a display panel, the timing controller comprising: a first interface configured to receive data from a host device; and a second interface configured to communicate with another timing controller for driving the display panel, wherein the second interface is configured to communicate full link training information with the other timing controller.

The second interface may be configured to communicate panel self-refresh information with the other timing controller.

The second interface may be configured to communicate the full link training information with the other timing controller during a first period and to communicate panel self-refresh information with the other timing controller during a second period.

The first period may be a system booting operation period and the second period may be a display operation period.

The display operation period may be a vertical blank interval.

The timing controller may further include a register configured to store information received from the other timing controller via the second interface.

The first interface may be configured to communicate with the host device via a hot plug detect (HPD) line, an auxiliary (AUX) channel, and a first main link (ML).

The register may be configured to store first status information of the first ML and to store second status information of a second ML received by the second interface from the other timing controller.

The first interface may be configured to provide the stored first status information and the stored second status information to the host device via the AUX channel.

The first interface may be configured to receive information from the host device via the AUX channel; and the second interface may be configured to transmit full link training information, based on the received information, to the other timing controller.

The first interface may be configured to receive the data from the host device via an ML.

The second interface may be configured to transmit status information of the ML to the other timing controller.

The first interface may be configured to receive, via the ML, training pattern data from the host device; and the second interface may be configured to transmit result data based on the received training pattern data.

The training pattern data may include at least one of clock pattern data and random pattern data having a constant period.

The timing controller may be mounted in a chip on glass.

According to an aspect of another exemplary embodiment, there is provided a display device including: a display panel; a first timing controller configured to drive the display panel based on first data received from the host device; and a second timing controller configured to drive the display panel based on second data received from the host device, wherein the first timing controller and the second timing controller are configured to communicate full link training information with each other.

The first timing controller and the second timing controller may be configured to communicate panel self-refresh information with each other.

The first timing controller may include a register configured to store information received from the second timing controller.

The first timing controller may be configured to communicate with the host device via a hot plug detect (HPD) line, an auxiliary (AUX) channel, and a first main link (ML).

The register may be configured to store first status information of the first ML and to store second status information of the second ML received from the second timing controller.

The first timing controller may be configured to provide the stored first status information and the stored second status information to the host device via the AUX channel.

The first timing controller may be configured to receive information from the host device via the AUX channel, and to transmit full link training information, based on the received information, to the second timing controller.

The second timing controller may be configured to receive the data from the host device via an ML.

The second timing controller may be configured to transmit status information of the ML to the first timing controller.

The second timing controller may be configured to receive, via the ML, training pattern data from the host device, and to transmit, to the first timing controller, result data based on the received training pattern data.

The training pattern data may include at least one of clock pattern data and random pattern data having a constant period.

The display panel, the first timing controller, and the second timing controller may be provided in a chip on glass.

According to an aspect of another exemplary embodiment, there is provided a method of driving a display panel, the method including: receiving, by a timing controller for driving the display panel, data from a host device; and transmitting, by the timing controller to another timing controller for driving the display panel, full link training information based on the received data.

The method may further include transmitting, by the timing controller to the other timing controller, panel self-refresh information.

The receiving the data from the host device may include receiving the data from the host device via an auxiliary (AUX) channel.

The method may further include receiving, by the timing controller, status information of a main link (ML) from the other timing controller.

The method may further include providing, by the timing controller, the received status information to the host device via the AUX channel.

The receiving the data from the host device may include receiving the data from the host device via an ML.

The transmitting the full link training information may include transmitting, by the timing controller, status information of the ML to the other timing controller.

The receiving the data from the host device via the ML may include receiving, via the ML, training pattern data from the host device; and the transmitting the full link training information may include transmitting, to the other timing controller, result data based on the received training pattern data.

The training pattern data may include at least one of clock pattern data and random pattern data having a constant period.

According to an aspect of another exemplary embodiment, there is provided a multi embedded timing controller including: a master TED configured to communicate with a host device through an embedded display port (eDP); and at least one slave TED configured to be connected to the master TED through a sync bus, wherein the sync bus may be used for a full link training operation while booting a system and the sync bus may be used for a panel self-refresh (PSR) operation while a normal display operation.

The sync bus may transmit and receive information about a hot plug detect (HPD) indication, a lock, a training period, an auxiliary (AUX) indication, and slave training results while booting the system.

The sync bus may transmit and receive information about a HPD indication, PSR states, a slave PSR status, and a PSR2 identifier during a vertical blank interval.

The eDP may include a HPD line, an AUX channel, and a main link (ML), the HPD line may include information about a failure of the master TED or the slave TED, the AUX channel may include information about timing with respect to the ML, the ML may include a first to fourth MLs, and the host device may transmit a video stream to the master TED and the slave TED through the first to fourth MLs.

The AUX indication signal may indicate any one of the first to fourth MLs according to the number of toggles.

When the AUX indication signal toggles one time, the AUX indication signal may indicate the first ML, when the AUX indication signal toggles two times, the AUX indication signal may indicate the second ML, when the AUX indication signal toggles three times, the AUX indication signal may indicate the third ML, and when the AUX indication signal toggles four times, the AUX indication signal may indicate the fourth ML.

The first ML and the second ML may be connected to the master TED, the third ML and the fourth ML may be connected to the slave TED, and the host device may transmit a secondary data packet (SDP) to the master TED through the first ML and the second ML and the slave TED through the third ML and the fourth ML while the normal display operation.

The host device may transmit information about a PSR2 operation in the SDP to the slave TED through the third ML and the host device may copy the information about the PSR2 operation into a reserved area corresponding to the first ML and transmit the copied information about the PSR2 operation to the master TED through the first ML.

The master TED may include a display port configuration data (DPCD) register serving as an internal register set and the DPCD register may store timing information.

According to an aspect of another exemplary embodiment, there is provided a display panel including: a multi TED, wherein the multi TED may include a master TED configured to communicate with a host device through an eDP; and at least one slave TED configured to be connected to the master TED through a sync bus, wherein the sync bus may be used for a full link training operation while booting a system and the sync bus may be used for a PSR operation while a normal display operation.

The sync bus may transmit and receive information about a hot plug detect (HPD) indication, a lock, a training period, an auxiliary (AUX) indication, and slave training results while booting the system.

The sync bus may transmit and receive information about a HPD indication, PSR states, a slave PSR status, and a PSR2 identifier during a vertical blank interval.

The eDP may include a HPD line, an AUX channel, and an ML, the HPD line may include information about a failure of the master TED or the slave TED, the AUX channel may include information about timing with respect to the ML, the ML may include a first to fourth MLs, and the host device may transmit a video stream to the master TED and the slave TED through the first to fourth MLs.

The AUX indication signal may indicate any one of the first to fourth MLs according to the number of toggles.

When the AUX indication signal toggles one time, the AUX indication signal may indicate the first ML, when the AUX indication signal toggles two times, the AUX indication signal may indicate the second ML, when the AUX indication signal toggles three times, the AUX indication signal may indicate the third ML, and when the AUX indication signal toggles four times, the AUX indication signal may indicate the fourth ML.

The first ML and the second ML may be connected to the master TED, the third ML and the fourth ML may be connected to the slave TED, and the host device may transmit a secondary data packet (SDP) to the master TED through the first ML and the second ML and the slave TED through the third ML and the fourth ML while the normal display operation.

The host device may transmit information about a PSR2 operation in the SDP to the slave TED through the third ML and the host device may copy the information about the PSR2 operation into a reserved area corresponding to the first ML and transmit the copied information about the PSR2 operation to the master TED through the first ML.

The master TED may include a DPCD register serving as an internal register set and the DPCD register may store timing information.

According to an aspect of another exemplary embodiment, there is provided a computer system including: a host device; and a display panel including a multi TED, wherein the multi TED includes a master TED configured to communicate with a host device through an eDP; and at least one slave TED configured to be connected to the master TED through a sync bus, wherein the sync bus may be used for a full link training operation while booting a system and the sync bus may be used for a PSR operation while a normal display operation.

The sync bus may transmit and receive information about a hot plug detect (HPD) indication, a lock, a training period, an auxiliary (AUX) indication, and slave training results while booting the system.

The sync bus may transmit and receive information about a HPD indication, PSR states, a slave PSR status, and a PSR2 identifier during a vertical blank interval.

The eDP may include a HPD line, an AUX channel, and an ML, the HPD line may include information about a failure of the master TED or the slave TED, the AUX channel may include information about timing with respect to the ML, the ML may include a first to fourth MLs, and the host device may transmit a video stream to the master TED and the slave TED through the first to fourth MLs.

The AUX indication signal may indicate any one of the first to fourth MLs according to the number of toggles.

When the AUX indication signal toggles one time, the AUX indication signal may indicate the first ML, when the AUX indication signal toggles two times, the AUX indication signal may indicate the second ML, when the AUX indication signal toggles three times, the AUX indication signal may indicate the third ML, and when the AUX indication signal toggles four times, the AUX indication signal may indicate the fourth ML.

The first ML and the second ML may be connected to the master TED, the third ML and the fourth ML may be connected to the slave TED, and the host device may transmit a secondary data packet (SDP) to the master TED through the first ML and the second ML and the slave TED through the third ML and the fourth ML while the normal display operation.

The host device may transmit information about a PSR2 operation in the SDP to the slave TED through the third ML and the host device may copy the information about the PSR2 operation into a reserved area corresponding to the first ML and transmit the copied information about the PSR2 operation to the master TED through the first ML.

The master TED may include a DPCD register serving as an internal register set and the DPCD register may store timing information.

Each of the display panel and the multi TED may be mounted on a chip on glass (COG).

BRIEF DESCRIPTION OF THE DRAWINGS

The foregoing and other features and advantages of the inventive concepts will be apparent from the more particular description of exemplary embodiments, as illustrated in the accompanying drawings in which like reference characters refer to the same parts throughout the different views. The drawings are not necessarily to scale, emphasis instead being placed upon illustrating the principles of the inventive concepts. In the drawings:

FIG. 6 is a table for defining a sync bus according to an operation of the display device shown in FIGS. 4 and 5, according to an exemplary embodiment;

FIG. 12 is a table illustrating a packet of video data transmitted from the host device, according to an exemplary embodiment;

FIG. 13 is a table illustrating four lanes of the main link, according to an exemplary embodiment;

DETAILED DESCRIPTION OF EXEMPLARY EMBODIMENTS

Figure 1:
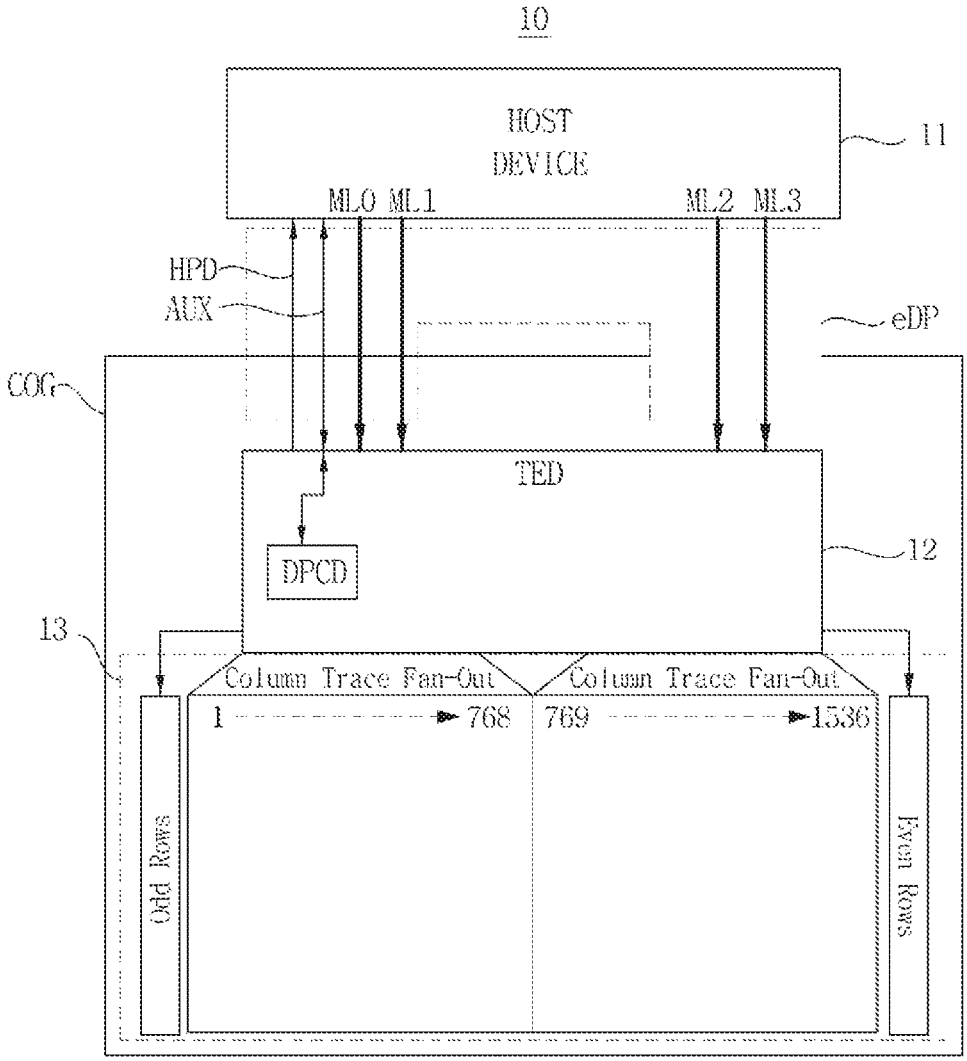
FIG. 1 RELATED ART
FIG. 1 is a block diagram illustrating a display device according to a related art.

Exemplary embodiments are described below in sufficient detail to enable those of ordinary skill in the art to embody and practice the present inventive concept. It is important to understand that the present inventive concept may be embodied in many alternate forms and should not be construed as limited to the exemplary embodiments set forth herein.

While an exemplary embodiment is susceptible to various modifications and alternative forms, specific exemplary embodiments are shown by way of example in the drawings and will herein be described in detail. It should be understood, however, that there is no intent to limit exemplary embodiments to the particular forms disclosed, but on the contrary, exemplary embodiments cover all modifications, equivalents, and alternatives falling within the spirit and scope of the inventive concept.

It will be understood that, although the terms first, second, A, B, etc., may be used herein in reference to elements of exemplary embodiments, such elements should not be construed as limited by these terms. For example, a first element could be termed a second element, and a second element could be termed a first element, without departing from the scope of the present invention. Herein, the term "and/or" includes any and all combinations of one or more referents. Furthermore, expressions such as "at least one of," when preceding a list of elements, modify the entire list of elements and do not modify the individual elements of the list.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements. Other words used to describe relationships between elements should be interpreted in a like fashion (i.e., "between" versus "directly between," "adjacent" versus "directly adjacent," etc.).

The terminology used herein to describe exemplary embodiments is not intended to limit the scope of the inventive concept. The articles "a," "an," and "the" are singular in that they have a single referent, however the use of the singular form in the present document should not preclude the presence of more than one referent. In other words, elements referred to in singular may number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art to which exemplary embodiments belong. It will be further understood that terms in common usage should also be interpreted as is customary in the relevant art and not in an idealized or overly formal sense unless expressly so defined herein.

Meanwhile, when it is possible to implement any exemplary embodiment in any other way, a function or an operation specified in a specific block may be performed differently from a flow specified in a flowchart. For example, consecutive two blocks may actually perform the function or the operation simultaneously, and the two blocks may perform the function or the operation conversely according to a related operation or function.

Exemplary embodiments will now be described below with reference to attached drawings.

FIG. 1 is a block diagram illustrating a display device 10 according to a related art.

Referring to FIG. 1, the display device 10 according to a related art may include a host device 11, a single embedded timing controller (TED) 12, and a display panel 13. The display device 10 may be implemented as or with a notebook computer or a tablet PC.

A TED 12 denotes a timing controller (TCON) that is embedded or an embedded TCON.

The host device 11 may transmit a video stream to the single TED 12 using an embedded display port (eDP). The host device 11 may include a microprocessor or an application processor. Further, the host device 11 may be implemented with a system-on-chip (SoC).

The eDP may include a hot plug detect (HPD) line, an auxiliary (AUX) channel or line, and a main link (ML).

The HPD line may include information about a failure with respect to the host device 11 and the single TED 12. The AUX channel may provide information, other than image data (e.g., a video stream), about an operation. For example, the AUX channel may provide extended display identification data (EDID), which is information about a resolution, a link-training status, and display port configuration data (DPCD) register. The ML may include data lanes. The host device 11 may transmit a video stream to the single TED 12 through the ML.

The single TED 12 may control the display panel 13. In response to control of the single TED 12, the display panel 13 may display the video stream.

The single TED 12 and the display panel 13 on a chip on glass (COG) may be implemented.

The single TED 12 may display the video stream by controlling each column and each row of the display panel 13.

Figure 2:
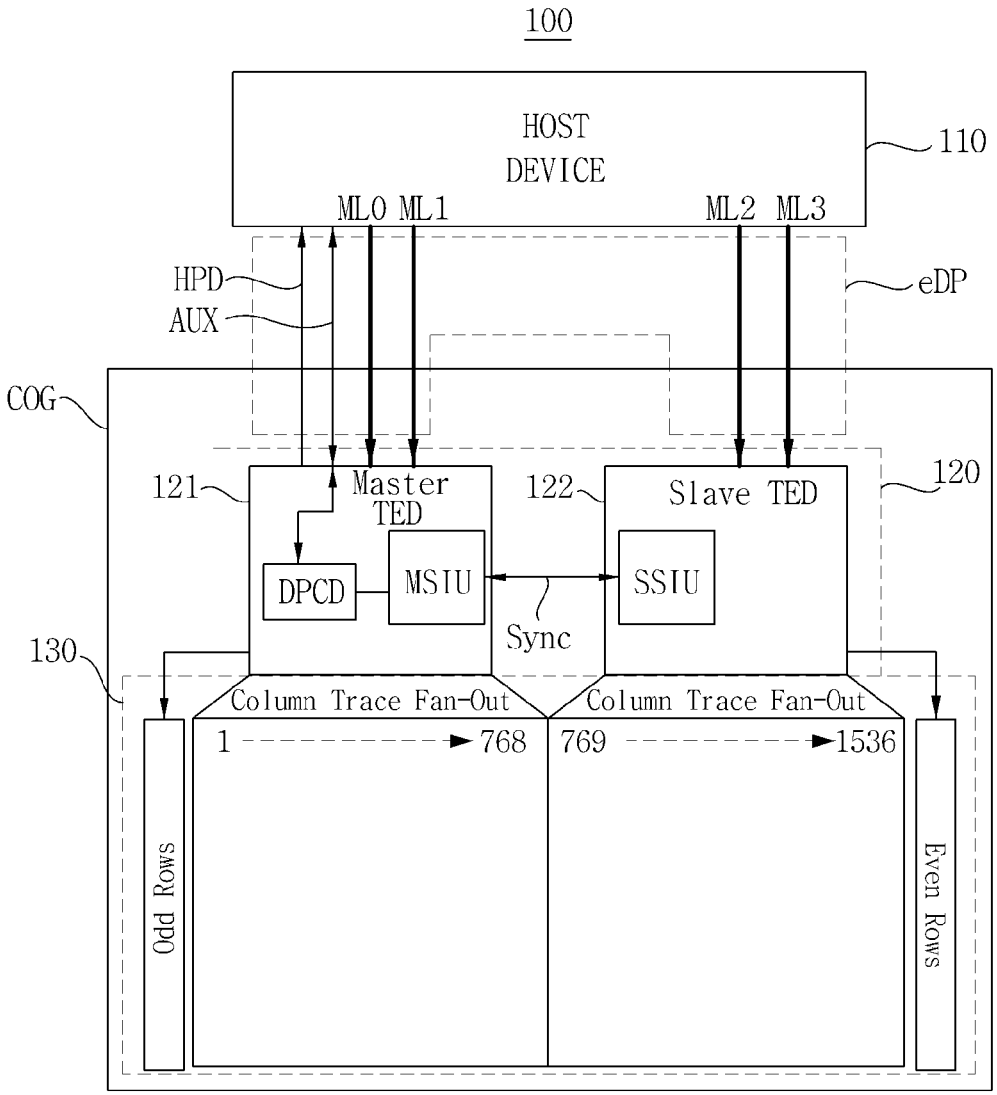
FIG. 2 is a block diagram illustrating a display device according to an exemplary embodiment.

FIG. 2 is a block diagram illustrating a display device 100 according to an exemplary embodiment.

Referring to FIG. 2, the display device 100 according to an exemplary embodiment may include a host device 110, a multi TED 120, and a display panel 130. In an exemplary embodiment, the display device 100 may be implemented in or as a notebook computer, a mobile device, a portable multimedia player, an Internet of Things (IoT) device, a PC, a display device, a smart device, a tablet PC, etc., although it is understood that one or more other exemplary embodiments are not limited thereto. Furthermore, the multi TED 120 and the display panel 130 may implemented on a chip on glass (COG). In this case, the timing controllers 121 and 122 may be mounted in a COG.

The host device 110 may transmit a video stream to the multi TED 120 using an eDP. In an exemplary embodiment, the host device 110 may include at least one of a microprocessor and an application processor. Further, the host device 110 may be implemented with a SoC.

The multi TED 120 may include a plurality of timing controllers, including a master TED 121 and at least one slave TED 122. In an exemplary embodiment, the multi TED 120 may include two TEDs or four TEDs, although it is understood that one or more other exemplary embodiments are not limited thereto, and any number of timing controllers may be included (e.g., three timing controllers, five timing controllers, six timing controllers, etc.).

For example, when the multi TED 120 includes two TEDs, the multi TED 120 may include a master TED 121 and a slave TED 122. Further, when the multi TED 120 includes four TEDs, the multi TED 120 may include a master TED, a first slave TED, a second slave TED, and a third slave TED.

In the multi TED 120, the master TED 121 and the slave TED 122 may be connected to the host device 110 via a first interface included in each TED 121 and 122. For example, the master TED 121 may be connected to and/or configured to communicate with the host device 110 via an HPD line, an AUX channel, and one or more MLs, e.g., a first ML ML0, and a second ML ML1. Moreover, the slave TED 122 may be connected to and/or configured to communicate with the host device 110 via one or more MLs, e.g., a third ML ML2, and a fourth ML ML3.

The slave TED 122 and the master TED 121 may transmit information and data to each other via a second interface (e.g., an interface to communicate over a sync bus Sync) included in each TED 121 and 122. Furthermore, the master TED 121 may transmit information or data received from the slave TED 122 to the host device 110 through the HPD line and/or the AUX channel. For example, the slave TED 122 may transmit failure information regarding a failure with respect to the host device 110 and/or the slave TED 122 to the master TED 121 through the sync bus Sync, and the master TED 121 may transmit the failure information received from the slave TED 122 to the host device 110 through the HPD line.

Moreover, by way of example, the slave TED 122 may transmit, to the master TED 121 through the sync bus SYNC, status information of one or more MLs (e.g., a third ML ML2, and a fourth ML ML3). Additionally, by way of example, the slave TED 122 may receive, via one or more MLs, training pattern data from the host device 110 and transmit result data based on the received training pattern data to the master TED 121 through the sync bus Sync. The master TED 121 may store (e.g., in a register) the received data and/or information (e.g., status information, result data, failure information, etc.) and/or transmit the received data and/or information to the host device 110 through the HPD line (e.g., in the case of failure information) and/or the AUX channel (e.g., in the case of the status information and the result data).

Furthermore, the master TED 121 may transmit information and/or data to the slave TED 122 through the sync bus SYNC. For example, the master TED 121 may transmit timing information, training information (e.g., full link training information), panel self-refresh information, etc., to the slave TED 122 through the sync bus SYNC.

The master TED 121 may include a register, e.g., a DPCD register that is an internal register set.

The slave TED 122 may be normally operated even though timing information is not received directly from the host device 110. In this regard, the master TED 121 may transmit information (e.g., timing information) received from the host device 110 via the HPD line and/or the AUX channel to the slave TED 122 through the sync bus Sync.

Each of the master TED 121 and the slave TED 122 may communicate through the sync bus Sync. In an exemplary embodiment, the sync bus Sync may include a serial peripheral interface (SPI) bus.

Each of the master TED 121 and the slave TED 122 may include the second interface or a sync interface unit (e.g., sync interface or sync interface device) for communicating with the sync bus Sync.

For example, the master TED 121 may include a master sync interface unit (MSIU). Further, the slave TED 122 may include a slave sync interface unit (SSIU).

Each of the master TED 121 and the slave TED 122 may control the display panel 130. By way of example, the master TED 121 may control a left region of the display panel 130, and the slave TED 122 may control a right region of the display panel 130.

For example, when the display panel 130 has a resolution of 1536×2048, which is a quad extended graphics array (QXGA), the master TED 121 may control first to seven hundred sixty eighth columns of the display panel 130 and the slave TED 122 may control seven hundred sixty ninth to one thousand five hundred thirty sixth columns of the display panel 130.

The display panel 130 may display a video stream in response to a control from each of the master TED 121 and the slave TED 122.

Figure 3:
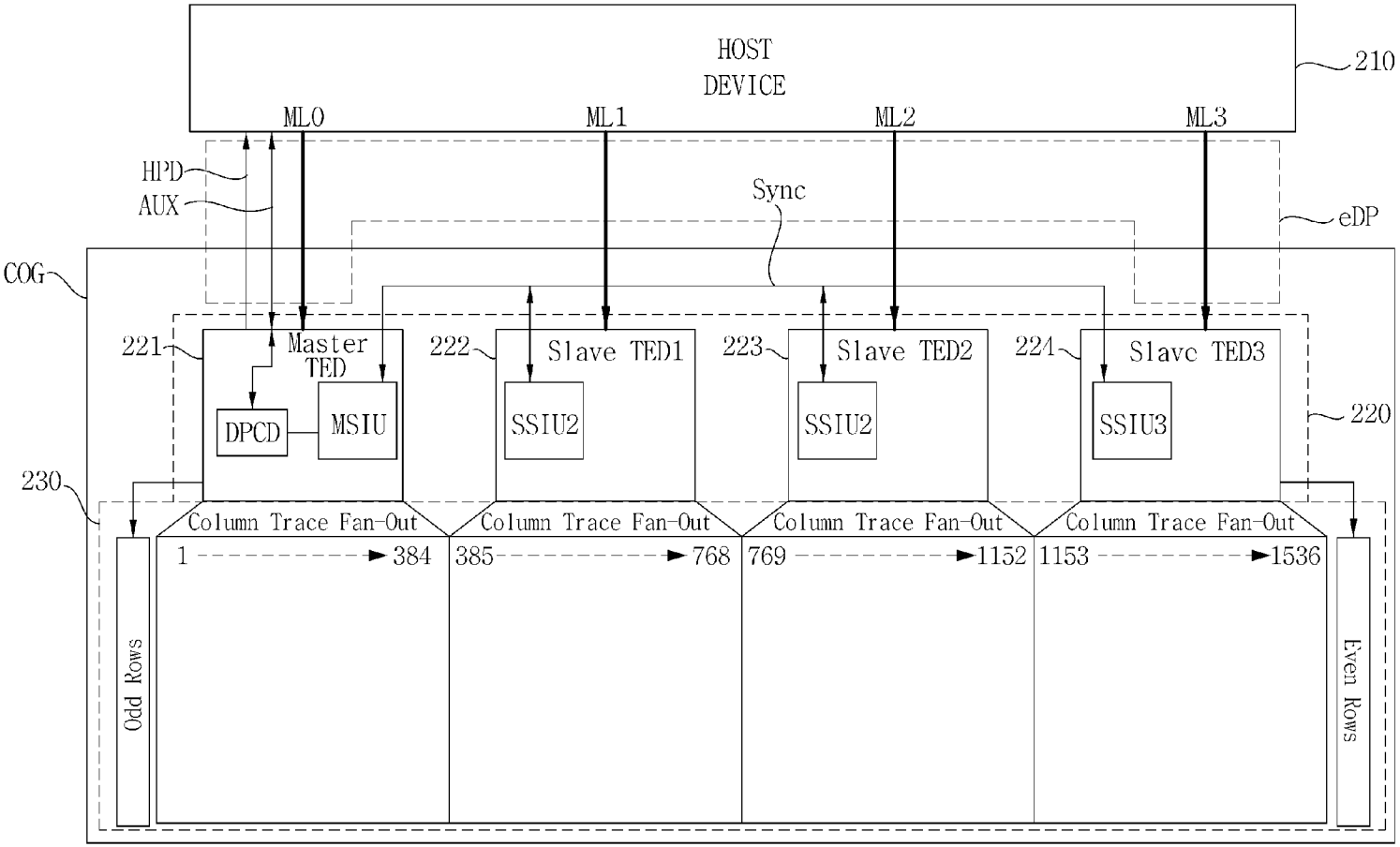
FIG. 3 is a block diagram illustrating a display device according to another exemplary embodiment.

FIG. 3 is a block diagram illustrating a display device 200 according to another exemplary embodiment.

Referring to FIG. 3, the display device 200 according to an exemplary embodiment may include a multi TED that includes four TEDs 221, 222, 223, and 224 (although it is understood that one or more other exemplary embodiments is not limited to this number of timing controllers). Specifically, the display device 200 includes a host device 210, a multi TED 220, and a display panel 230.

The host device 210 transmits a video stream to the multi TED 220 using the eDP standard interface.

The multi TED 220 may include a master TED 221, a first slave TED 222, a second slave TED 223, and a third slave TED 224.

The master TED 221, the first slave TED 222, the second slave TED 223, and the third slave TED 224 may be connected to the host device 210 via a first interface included in each of the TEDs 221, 222, 223, and 224. In this case, the master TED 221 may be connected to or configured to communicate with the host device 210 through an HPD line, an AUX channel, and a first ML ML0. The first slave TED 222 may be connected to or configured to communicate with the host device 210 via a second ML ML1. The second slave TED 223 may be connected to or configured to communicate with the host device 210 via a third ML ML2. The third slave TED 224 may be connected to or configured to communicate with the host device 210 via a fourth ML ML3.

Each of the master TED 221, the first slave TED 222, the second slave TED 223, and the third slave TED 224 may communicate with each other through a sync bus Sync). In an exemplary embodiment, the sync bus Sync may include a serial peripheral interface (SPI).

Each of the master TED 221, the first slave TED 222, the second slave TED 223, and the third slave TED 224 may include a second interface or a sync interface unit (e.g., sync interface or sync interface device) for communicating with or over the sync bus Sync.

For example, the master TED 221 may include a master sync interface unit (MSIU). The first slave TED 222 may include a first slave sync interface unit SSIU1. The second slave TED 223 may include a second slave sync interface unit SSIU2. The third slave TED 224 may include a third slave sync interface unit SSIU3.

Moreover, the master TED 121 may include a register, e.g., a DPCD register that is an internal register set.

Each of the master TED 221, the first slave TED 222, the second slave TED 223, and the third slave TED 224 may control the display panel 230. For example, when the display panel 230 has a resolution of 1536×2048, which is a QXGA, the master TED 221 may control first to three hundred eighty fourth columns of the display panel 130.

Moreover, the first slave TED 222 may control three hundred eighty fifth to seven hundred sixty eighth columns of the display panel 130. The second slave TED 223 may control seven hundred sixty ninth to one thousand one hundred fifty second columns of the display panel 130. The third slave TED 224 may control one thousand one hundred fifty third to one thousand five hundred thirty sixth columns of the display panel 130.

The display panel 230 may display a video stream in response to a control from each of the master TED 221, the first slave TED 222, the second slave TED 223, and the third slave TED 224.

Figure 4:
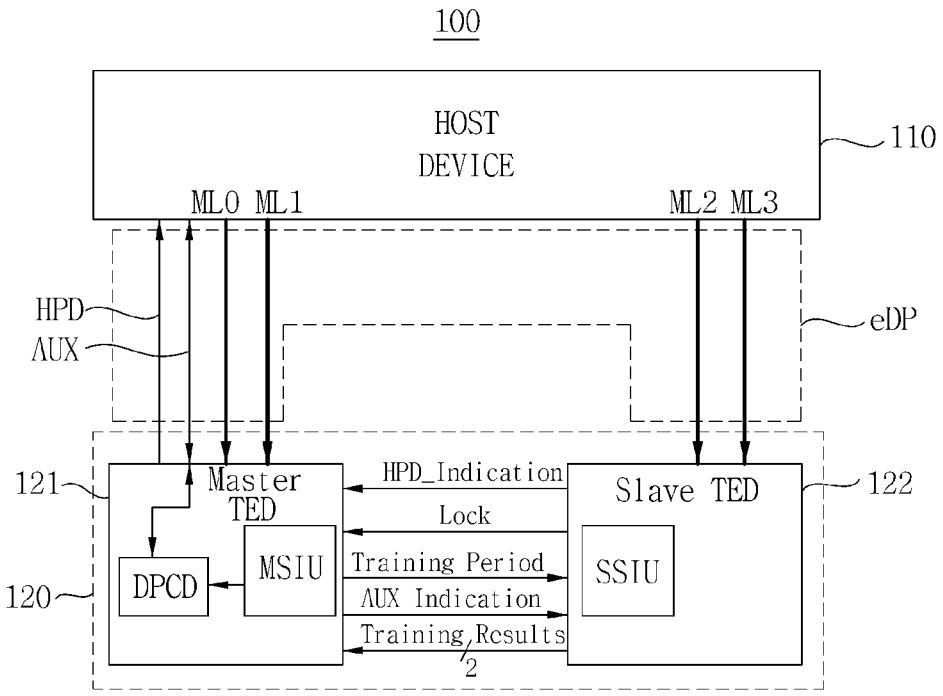
FIG. 4 is a conceptual diagram for describing a driving operation of the display device shown in FIG. 2, according to an exemplary embodiment.

FIG. 4 is a conceptual diagram for describing a driving operation of the display device 100 shown in FIG. 2, according to an exemplary embodiment.

Referring to FIGS. 2 and 4, a multi TED 120 includes a master TED 121 and a slave TED 122.

The host device 110 may not transmit a clock to the master TED 121.

Accordingly, the display device 100 may search for strobe timing of a video stream using a full link training operation in a system booting operation.

The sync bus Sync is connected between the master TED 121 and the slave TED 122.

For example, the sync bus Sync may be composed of 6 bits. The sync bus Sync may include information about at least one of an HPD indication, lock, a training period, an AUX indication, and slave training results. Here, the sync bus Sync may be defined according to the table shown in FIG. 6. In particular, as shown in FIG. 6, the master TED 121 and the slave TED 122 may be configured to communicate full link training information with each other during a first period (e.g., a system booting operation period), and may be configured to communicate panel self-refresh information with each other during a second period (e.g., a display operation period such as a vertical blank interval, a horizontal blank interval, or an active video data interval). A more detailed description will be provided below with reference to FIG. 6.

Figure 5:
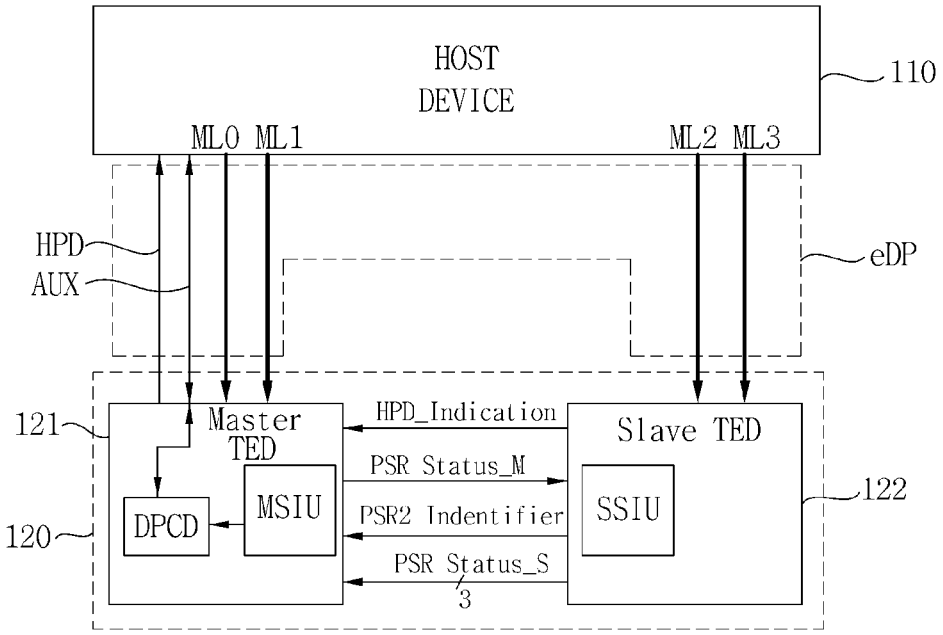
FIG. 5 is a conceptual diagram for describing another driving operation of the display device shown in FIG. 2, according to an exemplary embodiment.

FIG. 5 is a conceptual diagram for describing another driving operation of the display device 100 shown in FIG. 2, according to an exemplary embodiment.

Referring to FIGS. 2 and 5, a multi TED 120 includes a master TED 121 and a slave TED 122.

The display device 100 may perform a normal display operation. That is, the host device 110 may transmit a video stream to the multi TED 120 with a constant rate.

The rate is referred to as a refresh rate or a vertical frequency. When there is no change of image data, the rate may be maintained with a constant value. That is, because the host device 110 transmits image data to the multi TED 120, power may be consumed when a still image is displayed.

The multi TED 120 may include a panel self-refresh (PSR) function to reduce power consumption. The PSR function stops output of image data from the host device 110 and displays image data stored in a memory device (e.g., a frame memory) included in the multi TED 120 when the image data output from the host device 110 is a still image.

For example, the PSR function may be applied to a mobile device that is supplied power from a battery. Accordingly, the PSR function may extend a battery lifetime of the mobile device.

When the display device 100 operates in a PSR mode, each of the display panel 130 including the multi TED 120 and the host device 110 may reduce power consumption.

The DisplayPort™ specification 1.3 may support a PSR function. Moreover, the DisplayPort™ specification 1.4 may support a PSR2 function. The PSR2 function refers to a partial frame update.

The display device 100 may perform a PSR operation or a PSR2 operation.

For example, the sync bus Sync may be composed of 6 bits. The sync bus Sync may include information about an HPD indication, PSR states, a slave PSR status, and a PSR2 identifier. Here, the sync bus Sync may be defined according to the table shown in FIG. 6.

FIG. 6 is a table for defining a sync bus according to an operation of the display device 100 shown in FIGS. 4 and 5.

Referring to FIGS. 4, 5, and 6, the sync bus Sync may be defined in a system booting interval below.

According to an exemplary embodiment, during a system booting interval, a first bit S[0] of the sync bus Sync is used as an HPD indication. A second bit S[1] of the sync bus Sync is used as a lock signal. A third bit S[2] of the sync bus Sync is used as a training period. A fourth bit S[3] of the sync bus Sync is used as an AUX indication. Fifth and sixth bits S[4:5] of the sync bus Sync are used as slave training results.

The sync bus Sync may be defined in a vertical blank interval below.

According to an exemplary embodiment, during a vertical blank interval, a first bit S[0] of the sync bus Sync is used as a HPD indication. A second bit S[1] of the sync bus Sync is used as PSR States. Third to fifth bits S[2:4] of the sync bus Sync are used as a slave PSR status. A sixth bit S[5] of the sync bus Sync is used as a PSR2 Identifier.

The sync bus Sync may be defined in an active video data interval below.

According to an exemplary embodiment, during an active video data interval, a first bit S[0] of the sync bus Sync is used as a HPD indication. Second to fifth bits S[1:4] of the sync bus Sync are used as an SPI bus. A sixth bit S[5] of the sync bus Sync is used as a PSR2 identifier.

Figure 7:
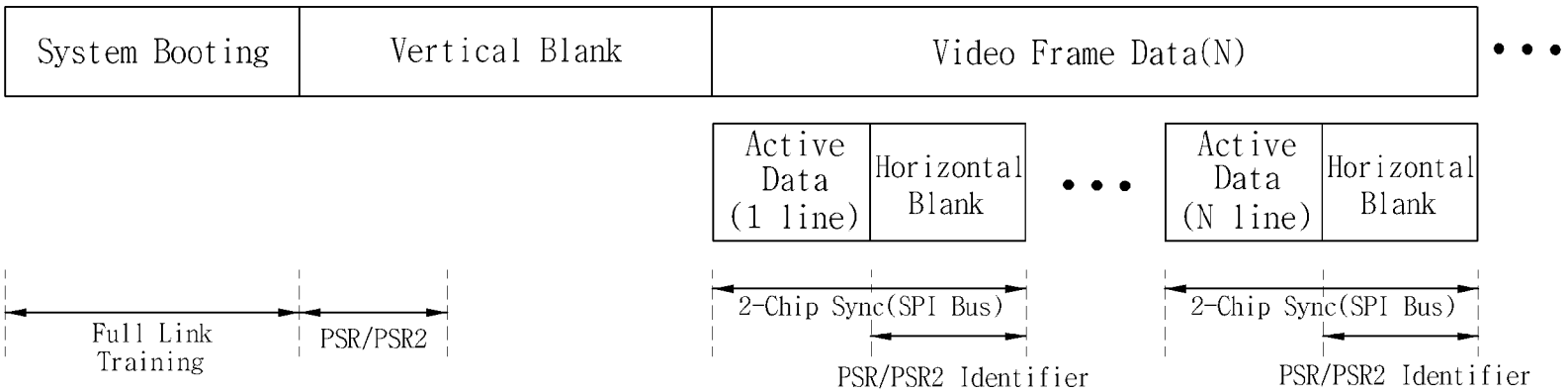
FIG. 7 is a conceptual diagram illustrating an operation of the display device shown in FIGS. 4 and 5, according to an exemplary embodiment.

FIG. 7 is a conceptual diagram illustrating an operation of the display device 100 shown in FIGS. 4 and 5, according to an exemplary embodiment.

Referring to FIGS. 4, 5, and 7, the display device 100 performs a full link training operation during a system booting operation.

Moreover, the display device 100 may perform a PSR/PSR2 operation during a vertical blank interval. An image of a frame is from a vertical blank to the next vertical blank.

A video frame data operation interval may be divided into N active data intervals corresponding to one line and N horizontal blank intervals. In a video frame data operation interval, the active data intervals and the horizontal blank intervals may be alternately allocated.

In the active data intervals, the host device 110 may transmit video frame data to the master TED 121 and the slave TED 122. Moreover, the display device 100 may perform a PSR/PSR2 operation during a horizontal blank operation.

A method of reducing a size of a sync bus Sync in a PSR operation, according to one or more exemplary embodiments, may be as described below with reference to FIGS. 8A to 8C in the PSR operation.

Figure 8A:
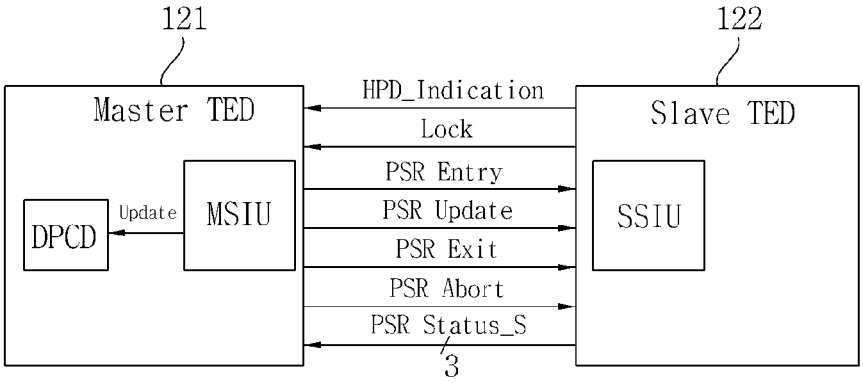
FIG. 8A is a block diagram illustrating a multi TED according to an exemplary embodiment.

FIG. 8A is a block diagram illustrating a PSR/PSR2 operation in a multi TED 120 according to an exemplary embodiment.

Referring to FIGS. 2 and 8A, the master TED 121 and the slave TED 122 may be connected through the sync bus Sync.

The sync bus Sync may be composed of 9 bits. The sync bus sync may include information about an HPD indication, lock (e.g., a lock status), a PSR entry, a PSR update, a PSR exit, and a PSR abort), and a PSR status_S.

For example, the master TED 121 transmits information about the PSR entry, the PSR update, the PSR exit, and the PSR abort to the slave TED 122. Moreover, the slave TED 122 transmits information about the HPD indication, the lock, and the PSR status_S to the master TED 121.

The lock signal is a signal activated when a clock is determined in a full link training operation. According to another exemplary embodiment, the slave TED 122 may not transmit information about the lock. The PSR entry signal is a PSR operation start signal. The PSR exit signal is a PSR operation exit signal. The PSR update signal is a signal updating one frame data in a PSR operation. The PSR_status_S signal denotes a status of the slave TED 122 in a PSR operation. Furthermore, according to another exemplary embodiment, additional information may be transmitted (e.g., a PSR2 identifier transmitted from the slave TED 122 to the master TED 121).

Figure 8B:
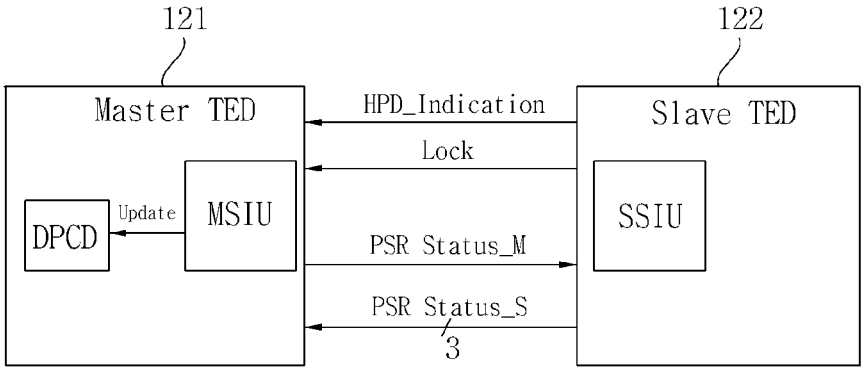
FIG. 8B is a block diagram illustrating a multi TED according to another exemplary embodiment.

FIG. 8B is a block diagram illustrating a PSR/PSR2 operation in the multi TED 120 according to another exemplary embodiment.

Referring to FIGS. 2 and 8B, the master TED 121 and the slave TED 122 may be connected through the sync bus Sync.

The sync bus Sync may be composed of 6 bits. The sync bus Sync may include information about an HPD indication, lock (e.g., a lock status), PSR_status_M, and PSR_status_S. The PSR_status_M signal may include information about the PSR entry, the PSR update, the PSR exit, and the PSR abort. According to one or more other exemplary embodiments, more or less information may be transmitted over the sync bus Sync for the PSR/PSR2 operation. For example, the lock status may be omitted and/or a PSR2 identifier transmitted from the slave TED 122 to the master TED 121.

A channel of the sync bus Sync may denote the PSR entry, the PSR update, the PSR exit, and the PSR abort using the number of toggles of the PSR_status_M.

A method for indicating the PSR entry, the PSR update, the PSR exit, and the PSR abort using the number of toggles according to an exemplary embodiment is described in detail below with reference to FIG. 8C.

Figure 8C:
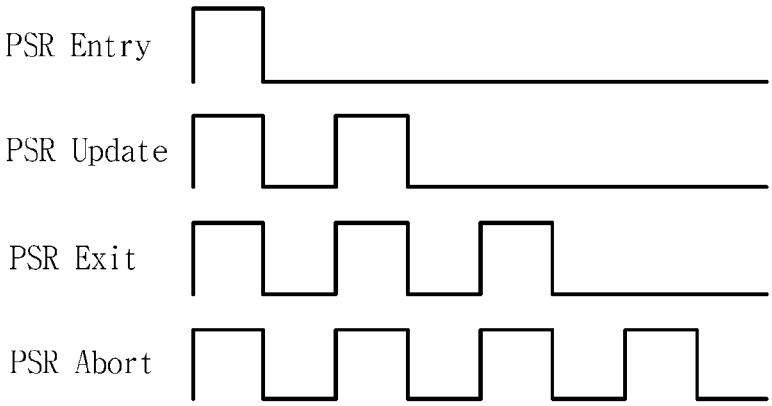
FIG. 8C is a timing diagram illustrating a PSR status_M shown in FIG. 8B.

FIG. 8C is a timing diagram illustrating a PSR_status_M shown in FIG. 8B.

Referring to FIGS. 8B and 8C, the PSR_status_M signal may include information about the PSR entry, the PSR update, the PSR exit, and the PSR abort. The PSR Status_M signal may denote PSR entry, the PSR update, the PSR exit, and the PSR abort using the number of toggles.

For example, when the PSR_status_M signal toggles one time, the PSR status_M signal denotes the PSR entry. When the PSR_status_M signal toggles two times, the PSR_status_M signal denotes the PSR update. When the PSR_Status_M signal toggles three times, the PSR_status_M signal denotes the PSR exit. When the PSR_status_M signal toggles four times, the PSR_status_M signal denotes the PSR abort.

Figure 9A:
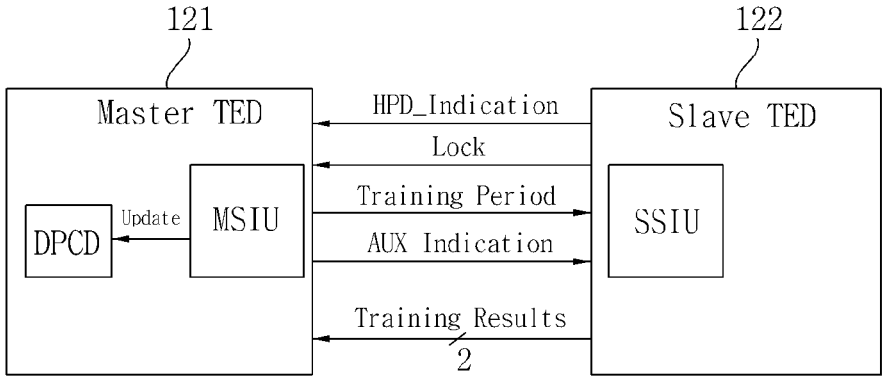
FIG. 9A is a block diagram illustrating a multi TED according to another exemplary embodiment.

FIG. 9A is a block diagram illustrating a full link training operation in a multi TED 120 according to another exemplary embodiment.

Referring to FIGS. 2 and 9A, the master TED 121 may transmit lane information to the slave TED 122 using the number of toggles of the AUX indication signal.

The master TED 121 and the slave TED 122 may be connected through the sync bus Sync. The sync bus Sync may be composed of 6 bits. The sync bus Sync may include information about an HPD indication, lock (e.g., a lock status), a training period, an AUX indication (e.g., a training indication), and training results. The AUX indication may denote the first to fourth MLs ML0 to ML3 using the number of toggles. By way of example, the HPD indication may indicate a failure with respect to the host device 110 or the multi TED 120, the lock signal may be activated when a clock is determined in a full link training operation or when there is a lock failure, the training period may be transmitted based on a start point indicator received by the master TED 121 from the host device 110 via the AUX channel, and the training results may correspond to a training result based on data (e.g., training pattern data) received by the slave TED 122 from the host device 110 via an ML.

A method for indicating the first ML ML0, the second ML ML1, the third ML ML2, and the fourth ML ML3 using the number of toggles according to an exemplary embodiment is described in detail below with reference to FIG. 9B.

Figure 9B:
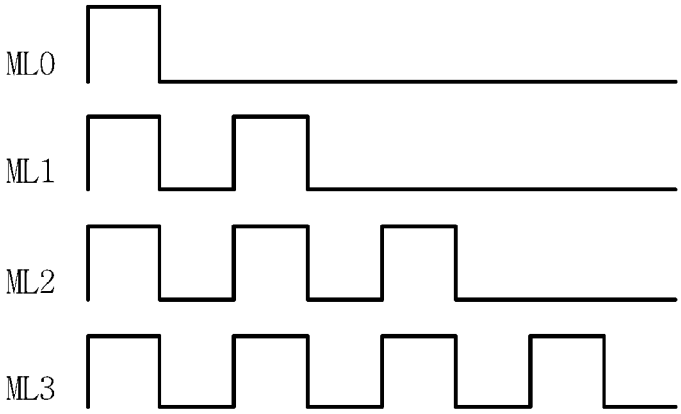
FIG. 9B is a timing diagram illustrating the AUX indication shown in FIG. 9A, according to an exemplary embodiment.

FIG. 9B is a timing diagram illustrating the AUX indication shown in FIG. 9A.

Referring to FIGS. 9A and 9B, the AUX indication signal may denote the first ML ML0, the second ML ML1, the third ML ML2, and the fourth ML ML3 using the number of toggles to reduce a size of the sync bus Sync.

For example, when the AUX indication signal toggles one time, the AUX indication signal denotes the first ML ML0. When the AUX indication signal toggles two times, the AUX indication signal denotes the second ML ML1. When the AUX indication signal toggles three times, the AUX indication signal denotes the third ML ML2. When the AUX indication signal toggles four times, the AUX indication signal denotes the fourth ML ML3.

Figure 10:
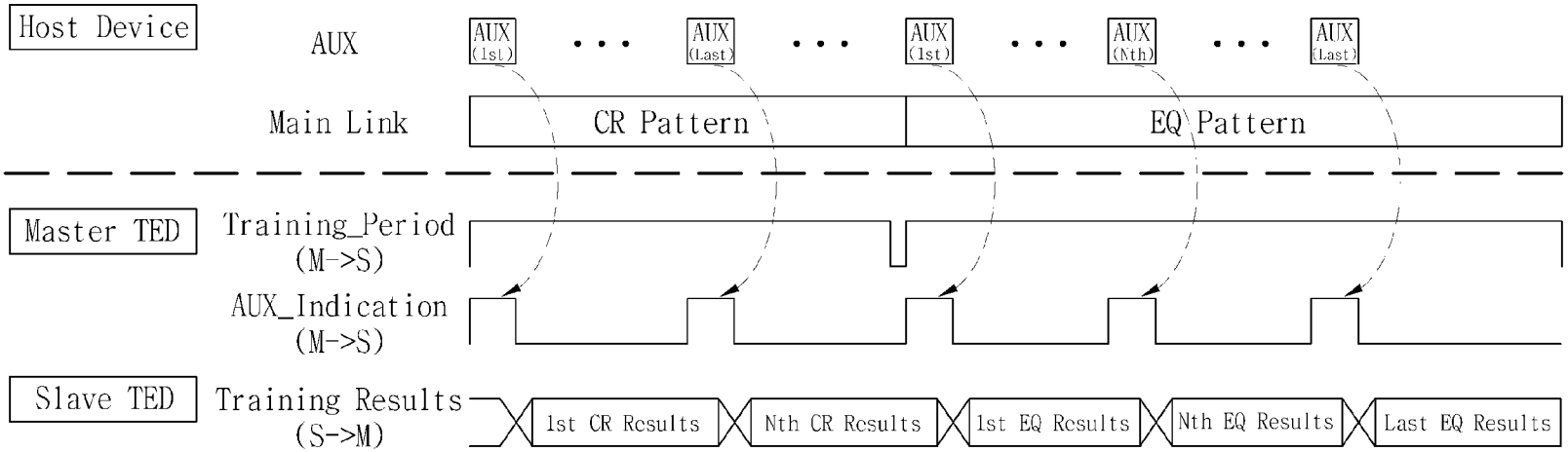
FIG. 10 is a timing diagram illustrating a sync operation between a master TED and a slave TED in a full link training operation, according to an exemplary embodiment.

FIG. 10 is a timing diagram illustrating a sync operation between the master TED 121 and the slave TED 122 in a full link training operation, according to an exemplary embodiment.

Referring to FIGS. 2 and 10, the host device 110 may periodically transmit the AUX signal to the master TED 121 through the AUX channel in a full link training operation. That is, the host device 110 may periodically transmit information about training time to the master TED 121 through the AUX channel.

Moreover, the host device 110 may transmit a full link training pattern to the master TED 121 and the slave TED 122 through the first to fourth MLs ML0 to ML3. In an exemplary embodiment, the full link training pattern may include a CR pattern and an EQ pattern.

The master TED 121 may transmit a training_period signal, which is information about a training period, to the slave TED 122. Moreover, the master TED 121 may transmit the AUX_indication signal to the slave TED 122.

The slave TED 122 may transmit training results to the master TED 121. That is, the slave TED 122 may transmit information about an amp/pre-emphasis request and locking to the master TED 121 in real time during a link training interval.

The master TED 121 may update information about a link training request and training results obtained from the slave TED 122 in the DPCD register of the master TED 121. The host device 110 may read the DPCD register from the master TED 121.

Figure 11:
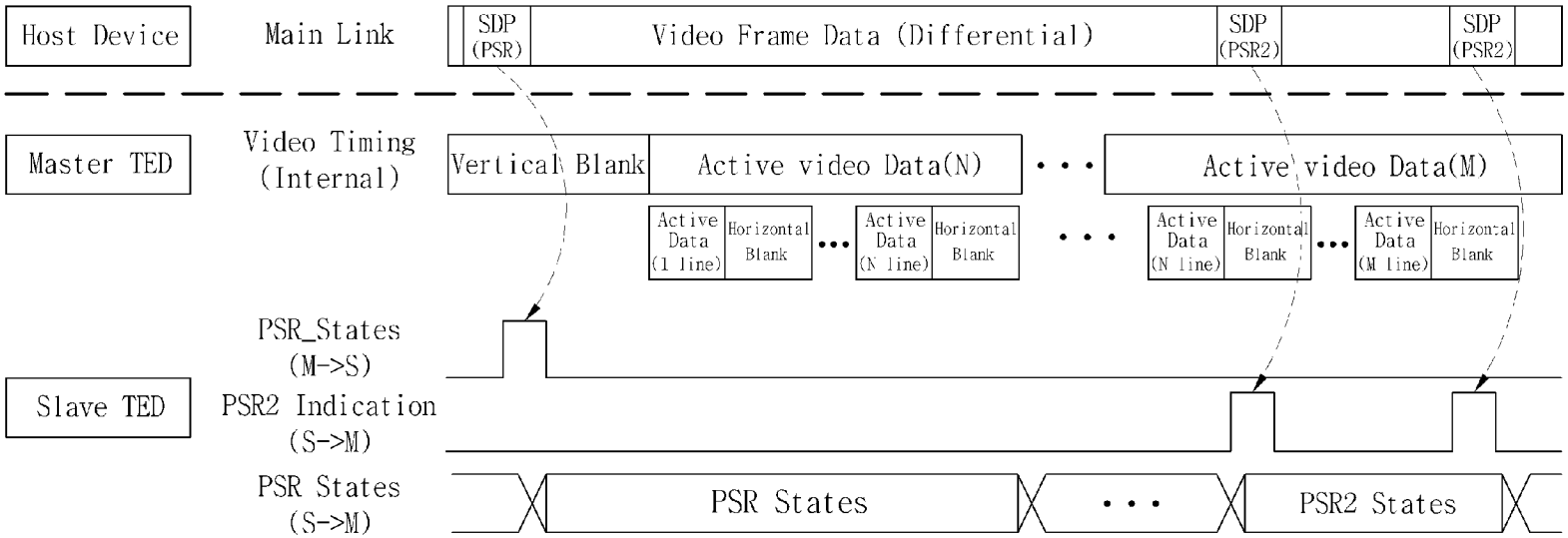
FIG. 11 is a timing diagram illustrating a sync operation between the master TED and the slave TED in a PSR/PSR2 operation, according to an exemplary embodiment.

FIG. 11 is a timing diagram illustrating a sync operation between the master TED 121 and the slave TED 122 in a PSR/PSR2 operation, according to an exemplary embodiment.

Referring to FIGS. 2 and 11, in a normal display operation, the host device 110 may transmit a secondary data packet (SDP), which is video frame data, to the master TED 121 and the slave TED 122 through the first to fourth MLs ML0 to ML3. A format of the SDP according to an exemplary embodiment is described in detail below with reference to FIG. 12.

During a vertical blank interval, the host device 110 may transmit the SDP to the master TED 121 and the slave TED 122 through the first to fourth MLs ML0 to ML3.

The master TED 121 may analyze the SDP input through the first ML ML0 and the second ML ML1 and transmit information about the PSR states to the slave TED 122 through the sync bus Sync. The information about the PSR states may include PSR entry, PSR update, PSR exit, and PSR abort.

The slave TED 122 may perform a PSR operation using information about PSR states transmitted from the master TED 121.

During a horizontal blank interval, the host device 110 may transmit information about PSR2 to the master TED 121 and the slave TED 122 through the first to fourth MLs ML0 to ML3. The information about PSR2 may include information about partial frame update start and partial frame update end.

To inform that PSR2 function is activated, the slave TED 122 may parse the information about the PSR2 and transmit a PSR2 indication and a PSR2 status to the master TED 121.

Through the process as described above, the master TED 121 and the slave TED 122 may perform a PSR operation or a PSR2 operation.

FIG. 12 is a table illustrating a packet of the video data transmitted from the host device 110, according to an exemplary embodiment.

Referring to FIG. 12, the host device 110 transmits a video stream to the multi TED 120. The SDP may be composed in a packet type or format.

The SDP may include HB0, HB1, HB2, and HB3, which are each composed of 8 bits. For example, the HB0 may store a packet ID. Moreover, the HB1 may store a packet type.

Moreover, the SDP may further include DB0 to DB31, which are composed of 8 bits. For example, the DB1 may include information about the PSR.

FIG. 13 is a table illustrating four lanes of the main link (ML), according to an exemplary embodiment.

Referring to FIGS. 2, 12, and 13, the host device 110 may transmit the SDP to the multi TED 120. In the present exemplary embodiment, the master TED 121 is connected to the first ML ML0 and the second ML ML1, and the slave TED 122 is connected to the third ML ML2 and the fourth ML ML3.

Information about a PSR operation may be transmitted through the first ML ML0 and the second ML ML1. Accordingly, the master TED 121 may distinguish the PSR states (i.e., PSR entry, PSR update, PSR exit, and PSR abort).

The master TED 121 may transmit the PSR states to the slave TED 122 through the sync bus Sync.

Likewise, information about a cyclic redundancy check (CRC) may be transmitted through the third ML ML2 and the fourth ML ML3. Accordingly, the slave TED 122 may transmit the information about the CRC to the master TED 121.

Figure 14:
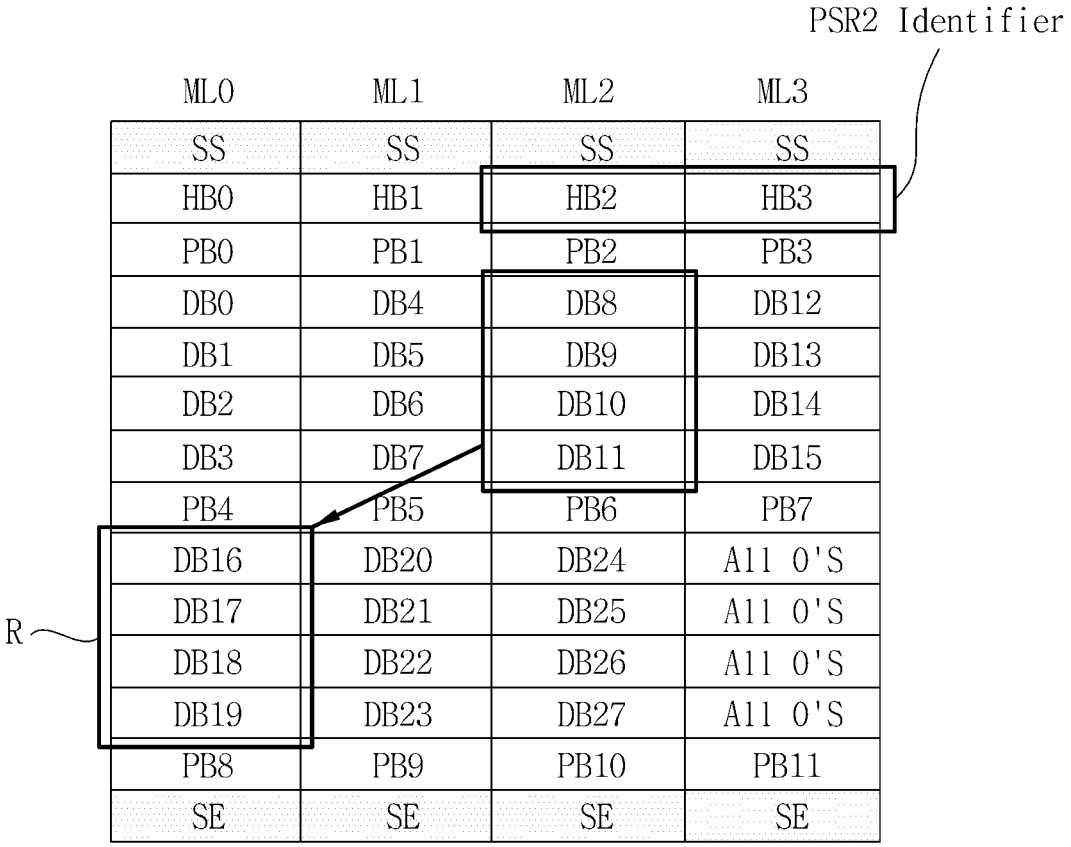
FIG. 14 is a table illustrating first to fourth MLs for describing a PSR2 packet configuration, according to an exemplary embodiment.

FIG. 14 is a table illustrating the first to fourth MLs for describing PSR2 packet configuration, according to an exemplary embodiment.

Referring to FIGS. 2, 12 and 14, the host device 110 transmits the SDP to the multi TED 120. In the present exemplary embodiment, the master TED 121 is connected to the first ML ML0 and the second ML ML1, and the slave TED 122 is connected to the third ML ML2 and the fourth ML ML3.

Information about X coordinates and a width driving for the PSR2 operation may be transmitted through the third ML ML2. The information may be stored in DS8, DB9, DB10, and DB11.

The host device 110 transmits information about a PSR2 operation in the SDP to the slave TED through the third ML. The host device 110 copies the information about the PSR2 operation into a reserved area corresponding to the first ML ML0 and transmits the copied information about the PSR2 operation to the master TED 121 through the first ML ML0.

For example, DB16, DB17, DB18, and DB19 of the SDP transmitted through the first ML ML1 are in a reserved area R. The host device 110 may copy, to the reserved area R, data (i.e., information about the PSR2 operation) stored in the DB8, the DB9, the DB10, and the DB11. Accordingly, the master TED 121 may receive the information about the X coordinates and the width driving for the PSR2 operation through the first ML ML0.

In an exemplary embodiment, the information about the PSR2 operation may include information about the X coordinates and the width for the PSR2 operation.

HB2 transmitted through the third ML ML2 and HB3 transmitted through the fourth ML ML3 correspond to the PSR2 Identifier. The slave TED 122 may determine information about PSR2 (i.e., HB2 and HB3) and transmit information about partial frame update timing to the master TED 121 through the sync bus Sync.

The host device 110 may transmit the information about the CRC to the slave TED 122 through the third ML ML2 and the fourth ML ML3. The slave TED 122 may transmit the information about the CRC to the master TED 121 through the sync bus Sync.

Figure 15:
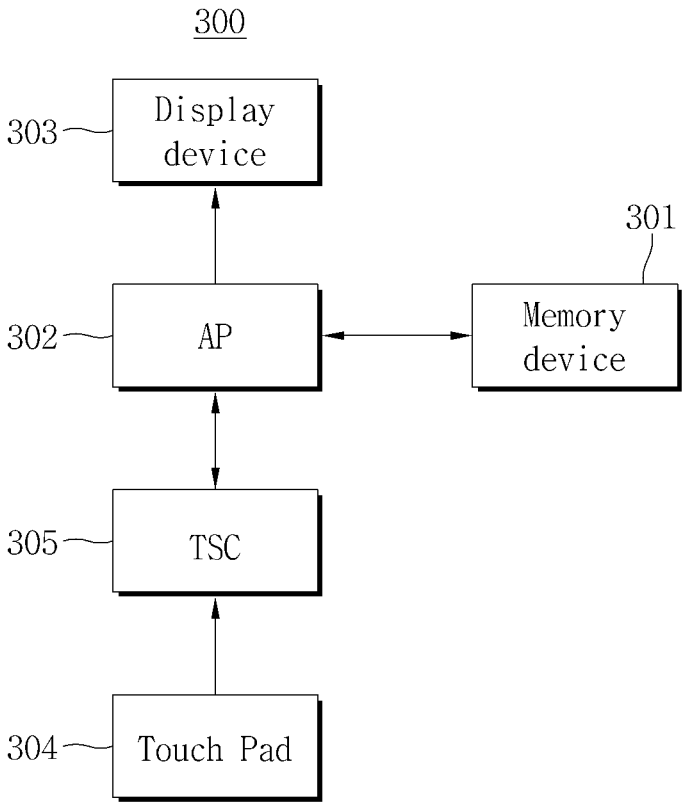
FIG. 15 is a block diagram illustrating a computer system 300 including the display device shown in FIG. 2, according to an exemplary embodiment.

FIG. 15 is a block diagram illustrating a computer system 300 including the display device shown in FIG. 2, according to an exemplary embodiment.

Referring to FIG. 15, the computer system 300 may be implemented as a personal computer (PC), a network server, a tablet PC, a netbook, an e-reader, a personal digital assistant (PDA), a portable multimedia player (PMP), an MP3 player, an MP4 player, a mobile phone, a smart device, a wearable device, an IoT device, etc.

The computer system 300 includes a memory device 301, an application processor (AP) 302 including a memory controller for controlling a data processing operation of the memory device 301, a display device 303, a touch pad 304, and a thyristor switched capacitor (TSC) 305.

The touch pad 304 may be a contact only sensor, a proximity sensor, or a combination contact and proximity sensor. The touch pad 304 may receive a touch signal from a user. In the present exemplary embodiment, the touch pad 304 transforms the touch signal into the amount of change of capacitance. The touch pad 304 transmits information about the amount of change of capacitance to the TSC 305. The TSC 305 transforms the information about the amount of change of capacitance into coordinate information. The TSC 305 transmits the coordinate information to the AP 302.

The AP 302 displays data stored in the memory device 301 through the display device 303 according to data input through the touch pad 304.

In an exemplary embodiment, the AP 302 may include the display device 100 shown in FIG. 2.

The multi TED according to an exemplary embodiment may be connected to a host without change of hardware or software of the host.

Further, the multi TED may perform PSR/PSR2 operations in response to control of the host without change of hardware or software of the host.

One or more exemplary embodiments may be applied to a display device and a computer system having the same.

Although a few exemplary embodiments have been described, those skilled in the art will readily appreciate that many modifications are possible without materially departing from the novel teachings and advantages. Accordingly, all such modifications are intended to be included within the scope of this inventive concept as defined in the claims.

What is claimed is:

1. A timing controller for driving a display panel, the timing controller comprising:

a first interface configured to receive data from a host device; and a second interface configured to communicate with another timing controller for driving the display panel, wherein the second interface is configured to communicate full link training information with the other timing controller, wherein the first interface is configured to receive the data from the host device via a first main link (ML), and wherein the second interface is configured to transmit status information of the first ML to the other timing controller.

2. The timing controller according to claim 1, wherein the second interface is configured to communicate panel self-refresh information with the other timing controller.

3. The timing controller according to claim 1, further comprising a register configured to store information received from the other timing controller via the second interface.

4. The timing controller according to claim 3, wherein the first interface is configured to communicate with the host device via a hot plug detect (HPD) line, an auxiliary (AUX) channel, and the first ML.

5. The timing controller according to claim 4, wherein the register is configured to store first status information of the first ML and to store second status information of a second ML received by the second interface from the other timing controller.

6. The timing controller according to claim 5, wherein the first interface is configured to provide the stored first status information and the stored second status information to the host device via the AUX channel.

7. The timing controller according to claim 1, wherein the timing controller is mounted in a chip on glass.

8. A timing controller for driving a display panel, the timing controller comprising:

a first interface configured to receive data from a host device; and a second interface configured to communicate with another timing controller for driving the display panel, wherein the second interface is configured to communicate full link training information with the other timing controller, and wherein the second interface is configured to communicate the full link training information with the other timing controller during a first period and to communicate panel self-refresh information with the other timing controller during a second period.

9. The timing controller according to claim 8, wherein the first period is a system booting operation period and the second period is a display operation period.

10. The timing controller according to claim 9, wherein the display operation period is a vertical blank interval.

11. A method of driving a display panel, the method comprising:

receiving, by a timing controller for driving the display panel, data from a host device; and transmitting, by the timing controller to another timing controller for driving the display panel, full link training information based on the received data, wherein the receiving the data from the host device comprises receiving the data from the host device via a first main link (ML), and wherein the transmitting the full link training information comprises transmitting, by the timing controller, status information of the first ML to the other timing controller.

12. The method according to claim 11, further comprising transmitting, by the timing controller to the other timing controller, panel self-refresh information.

13. The method according to claim 11, wherein the receiving the data from the host device comprises receiving the data from the host device via an auxiliary (AUX) channel.

14. The method according to claim 13, further comprising receiving, by the timing controller, status information of a second ML from the other timing controller.

15. The method according to claim 14, further comprising providing, by the timing controller, the received status information to the host device via the AUX channel.

16. The method according to claim 11, wherein:

the receiving the data from the host device via the first ML comprises receiving, via the first ML, training pattern data from the host device; and the transmitting the full link training information comprises transmitting, to the other timing controller, result data based on the received training pattern data.

17. The method according to claim 16, wherein the training pattern data comprises at least one of clock pattern data and random pattern data having a constant period.

* * * * *